US011040382B2

(12) United States Patent
Lokkinen

(10) Patent No.: US 11,040,382 B2
(45) Date of Patent: Jun. 22, 2021

(54) ADAPTIVE CLEANING DEVICE

(71) Applicant: PICOTE SOLUTIONS INC., Sammamish, WA (US)

(72) Inventor: Mika Lokkinen, Tallinn (EE)

(73) Assignee: PICOTE SOLUTIONS INC., Sammamish, WA (US)

( * ) Notice: Subject to any disclaimer, the term of this patent is extended or adjusted under 35 U.S.C. 154(b) by 0 days.

(21) Appl. No.: 17/044,359

(22) PCT Filed: Mar. 28, 2019

(86) PCT No.: PCT/EP2019/057899
§ 371 (c)(1),
(2) Date: Oct. 1, 2020

(87) PCT Pub. No.: WO2019/197167
PCT Pub. Date: Oct. 17, 2019

(65) Prior Publication Data

US 2021/0094082 A1 Apr. 1, 2021

(30) Foreign Application Priority Data

Apr. 9, 2018 (FI) ..... 20185331

(51) Int. Cl.

| | |
|---|---|
| ***B08B 9/045*** | (2006.01) |
| ***B08B 9/04*** | (2006.01) |
| ***B08B 7/02*** | (2006.01) |
| ***E03F 9/00*** | (2006.01) |
| ***B08B 9/043*** | (2006.01) |

(52) U.S. Cl.
CPC ..... *B08B 9/045* (2013.01); *B08B 7/02* (2013.01); *B08B 9/0436* (2013.01); *E03F 9/005* (2013.01)

(58) Field of Classification Search
CPC ..... B08B 9/045; B08B 9/0436; B08B 7/02; E03F 9/005
See application file for complete search history.

(56) References Cited

U.S. PATENT DOCUMENTS

| | | | | |
|---|---|---|---|---|
| 7,052,554 | B2 * | 5/2006 | Rothenberger | B08B 9/045 134/6 |
| 9,649,671 | B2 * | 5/2017 | Virtanen | B08B 9/045 |
| 2002/0000015 | A1 * | 1/2002 | Rothenberger | B08B 9/045 15/104.09 |
| 2005/0028306 | A1 * | 2/2005 | Bergstrom | E03F 9/005 15/104.31 |

(Continued)

FOREIGN PATENT DOCUMENTS

| | | | | |
|---|---|---|---|---|
| DE | 963485 | | 5/1957 | |
| DE | 963485 | C * | 5/1957 | B08B 9/0436 |

(Continued)

*Primary Examiner* — Marc Carlson
(74) *Attorney, Agent, or Firm* — Fasth Law Offices; Rolf Fasth

(57) ABSTRACT

The cleaning device is for cleaning the inner surface of pipes. The cleaning device has two sleeves on a flexible shaft and chains extending between the sleeves. A forward end sleeve is not attached to the shaft and is biased by a spring on the shaft. The cleaning device can be adapted to different pipe sizes by altering rotation speed of the cleaning device. High rotation speed compresses the spring and moves the chains further away from the shaft to enable cleaning of larger diameter pipes with the cleaning device.

6 Claims, 3 Drawing Sheets

(56) References Cited

U.S. PATENT DOCUMENTS

| | | | | |
|---|---|---|---|---|
| 2016/0121377 | A1* | 5/2016 | Virtanen | B08B 9/0436 15/104.09 |
| 2017/0368581 | A1* | 12/2017 | Lokkinen | B08B 9/0436 |
| 2018/0126430 | A1* | 5/2018 | Lokkinen | E03F 9/002 |
| 2018/0355599 | A1* | 12/2018 | Kippo | B08B 9/045 |
| 2019/0060966 | A1* | 2/2019 | Kippo | E03F 9/005 |

FOREIGN PATENT DOCUMENTS

| | | | | |
|---|---|---|---|---|
| EP | 2363213 | | 9/2011 | |
| EP | 2363213 | A2 * | 9/2011 | A46B 13/006 |
| EP | 3501675 | A1 * | 6/2019 | B08B 9/0436 |
| FI | 127112 | | 11/2017 | |
| WO | 2018162714 | | 9/2018 | |
| WO | WO-2018162714 | A1 * | 9/2018 | E03F 9/005 |

* cited by examiner

ADAPTIVE CLEANING DEVICE

PRIOR APPLICATIONS

This is a US national phase patent application that claims priority from PCT/EP2019/057899 filed 28 Mar. 2019, that claims priority from Finnish Patent Application No.

FIELD OF THE INVENTION

The invention relates to a device for cleaning a pipe from the inside of the pipe.

PRIOR ART

For cleaning the inside of pipes, such as, for example, sewage pipes that have been in use, many kinds of tools have been developed. At the present, a tool according to prior art consists of two end sleeves and steel chains connecting these, to the links of which are soldered sharp-edged hard metal or carbide pieces. The respective tool is used by tightening the sleeves onto a flexible shaft and rotating the flexible shaft, wherein the chains connecting the sleeves spread against the inner surface of the pipe and the carbide pieces detach dirt, rust and other undesired material from the inner surface of the pipe. The tool is chosen or adjusted based on the size of the pipe to be cleaned. The tool is rotated at rotational speeds from a few hundred to a few thousand RPM, depending i.a. on the diameter of the pipe and the desired cleaning efficiency.

One example of a cleaning chain according to prior art is the solution presented in U.S. Pat. No. 9,649,671, in which hard metal pieces are soldered to a chain.

A problem associated with the cleaning devices of the prior art is that a cleaning device for a large diameter pipe, e.g. 150 mm/6" pipe, is difficult or impossible to push into the large diameter pipe through a small diameter pipe, e.g. 70 mm/3" pipe. Different pipe diameters require different cleaning devices. Length of the chains in the cleaning device depends on the diameter of the pipe and larger diameter pipes require longer chains than smaller diameter pipes to ensure full contact between the chains and inner wall of the pipe. In a smaller diameter pipe preceding the larger diameter pipe, the extra length of the chains accumulates near the rear end of the cleaning device and increases the diameter of the cleaning tool, often to a larger diameter than the smaller pipe.

BRIEF DESCRIPTION OF THE INVENTION

The object of the invention is a cleaning device for cleaning a pipe. By the device, cleaning of pipes with varying diameter can be performed.

The cleaning device according to the present disclosure is based on the use of a non-rotating forward end sleeve which can be moved along a flexible shaft in the forward end of the cleaning device. The cleaning device also has a rear end sleeve fixedly attached the flexible shaft and two or more chains attached to the sleeves and extending between the sleeves. The forward end of the flexible shaft has a non-circular cross-section for preventing rotation of the sleeve. In addition, the cleaning device comprises a spring around the flexible shaft between the rear end sleeve and the forward end sleeve. Rotation of the cleaning device exerts a force on the chains in a direction perpendicular to the flexible shaft thereby extending the diameter of the tool. At the same time, the forward end sleeve is pulled towards the rear end sleeve due to the force acting on the chains and pushing the chains away from the flexible shaft. The spring between the forward end sleeve and the rear end sleeve compresses and resists the movement of the forward end sleeve. When rotation of the flexible shaft is stopped, the force pushing the chains away from the flexible shaft disappears and the spring extends back to its full length, thereby pushing the forward end sleeve away from the rear end sleeve and the chains settle next to the flexible shaft. This structure ensures minimal diameter of the cleaning tool when the cleaning tool is not rotated. Said structure also enables adaptation of the diameter of the cleaning device to various diameters by varying the rotation speed of the cleaning device. Various steel, hard metal or carbide blades or cutters can be attached to links of the chains to enhance cleaning function of the cleaning device.

BRIEF DESCRIPTION OF THE FIGURES

The invention is now described in more detail in connection with preferred embodiments with reference to the accompanying drawings, in which.

DETAILED DESCRIPTION OF THE INVENTION

Figure 1:
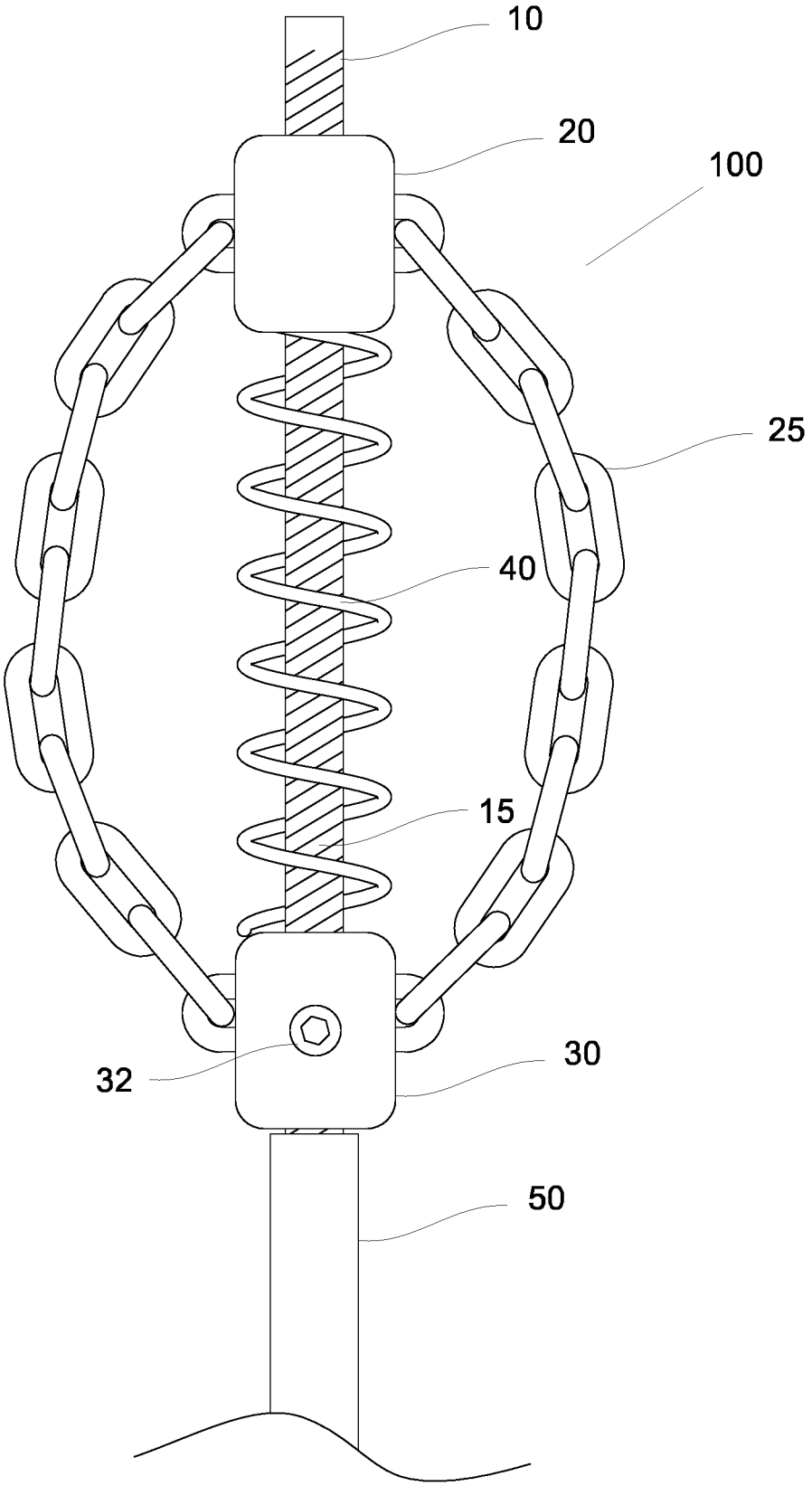
FIG. 1 illustrates a cleaning device according to an embodiment.

FIG. 1 shows a cleaning device 100 according to an embodiment of the present disclosure. The cleaning device comprises a rear end sleeve 30 and a forward end sleeve 20. Two chains are attached to the sleeves 20, 30, for example, by welding. In the embodiment of FIG. 1, each of the two chains has nine full links 25 and two partial links attached to the sleeves 20, 30. Both, the rear end sleeve 30 and the forward end sleeve 20, have an opening in the middle which extends through the sleeve thereby defining a through-hole in both sleeves. The rear end sleeve 30 has one or more threaded holes, which extend from the outer surface of the rear end sleeve 30 into the opening in the middle of the rear end sleeve. By means of the through-hole between the ends of the rear end sleeve 30, the rear end sleeve 30 can be attached to a flexible shaft 15, which is guided through said through-hole. The rear end sleeve is attached to the flexible shaft by one or more screws (32), for example, by friction screws, which are tightened from the threaded holes against the flexible shaft. Flexibility of the shaft allows it to be pushed through the corners and bends of the piping to be cleaned, but it is nonetheless stiff for pushing, which enables pushing of the cleaning device in the pipe even for long distances. The axis is preferably within a protective casing 50 in the portion between a driving motor and the rear end sleeve 30 of the cleaning device. The flexible shaft 15 is able to rotate inside the protective casing 15 but the casing enables a user to guide the flexible shaft by hands and thereby steer the cleaning device inside a pipe. The driving motor can be, for example, a drill, electric motor, pneumatic motor, hydraulic motor or a power transmission device manufactured for the purpose, which comprises a flexible axis and a motor that rotates it. A shaft connector can be used to connect a flexible axis of a power transmission device to the flexible shaft of the cleaning device 100.

Figure 9:
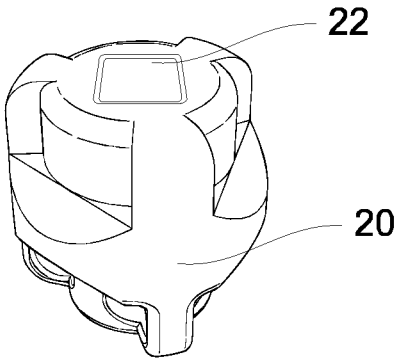
FIG. 9 illustrates a forward end sleeve according to an embodiment.

The through-hole defined in the middle of the forward end sleeve 20 has a non-circular cross-section. FIG. 9 illustrates an example of the forward end sleeve 20 defining a though-hole 22 having a square-shaped cross-section. Also other angular forms can be used, such as a triangle, hexagon, rectangle, octagon, and so forth. Also flat or elliptical shapes could be used. Even a circular cross-section with a recess or a protrusion could be used. The flexible shaft 15 is guided through said non-circular through-hole 22 of the forward end sleeve 20 so that a non-circular end portion 10 runs freely through the through-hole 22. Unlike the rear end sleeve 30, the forward end sleeve is not attached to the flexible shaft 15 but allowed to move freely within the end portion 10 of the flexible shaft 15.

Figure 2:
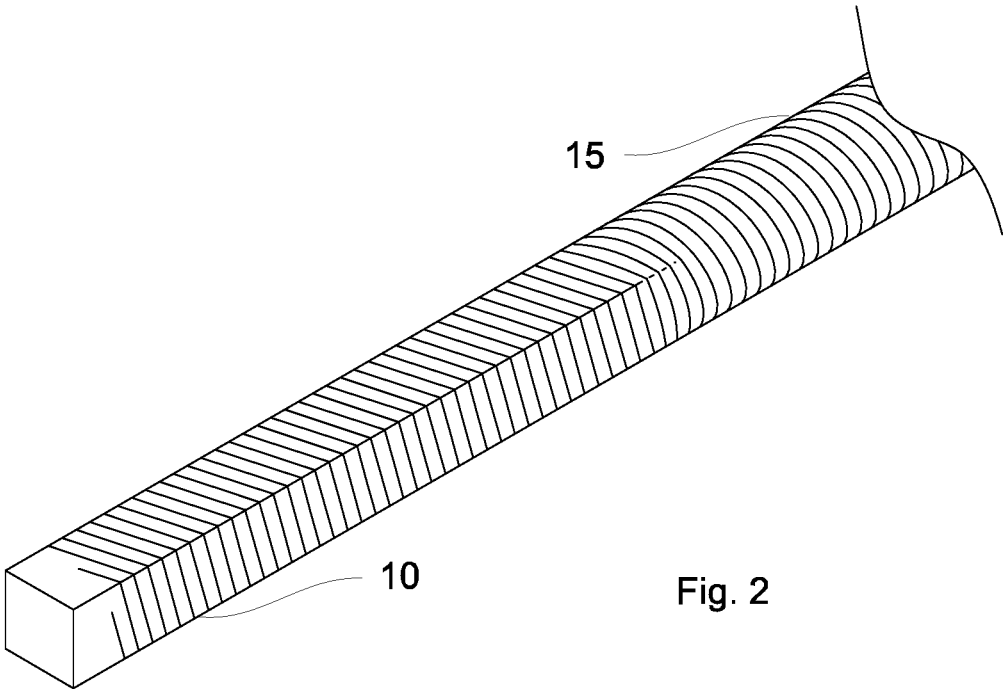
FIG. 2 illustrates a flexible shaft according to an embodiment.

FIG. 2 illustrates an embodiment of the flexible shaft 15 having an end portion 10 having a non-circular cross-section. In the embodiment of FIG. 2, the end portion 10 has a square-shaped cross-section. Also other angular forms can be used, such as a triangle, hexagon, rectangle, octagon, and so forth. Also flat or elliptical shapes could be used. Even a circular cross-section with a recess or a protrusion could be used. Preferably the cross-section of the end portion 10 of the flexible shaft 15 is essentially the same shape as the cross-section of the through-hole 22 defined in the middle of the forward end sleeve 20. The cross-section of the end portion 10 of the flexible shaft 15 is smaller in size than the cross-section of the through-hole 22 defined in the middle of the forward end sleeve 20 to allow for insertion of the end portion 10 through the through-hole 22 of the forward end sleeve 20. In this context, the term essentially the same shape means that the forward end sleeve 20 can be moved in longitudinal direction of the end portion 10 of the flexible shaft but that the forward end sleeve 20 cannot be fully rotated about the longitudinal axis of the end portion 10 when the end portion 10 runs through the through-hole 22 of the forward end sleeve 20.

Now referring back to FIG. 1 where the cleaning device 100 comprises a spring 40 around the flexible shaft 15 and at least partially around the non-circular end portion 10 of the flexible shaft 15. The spring 40 is located between the rear end sleeve 30 and the forward end sleeve 20 on the flexible shaft 15. The spring 40 is preferably a helical coil spring having a length substantially equal the length of a chain attached to the rear end sleeve and the forward end sleeve which chain length defines the maximum distance between the sleeves. The uncompressed length of the spring can be for example from 50% to 150%, more preferably from 80% to 120% and most preferably from 90% to 100% of the maximum distance between the rear end sleeve and the forward end sleeve. The spring 40 can be compressed to, for example, at least 40%, more preferably at least 60% or most preferably at least 80% of its uncompressed length. In an embodiment, more than one spring can be used. In case of multiple springs, the total uncompressed length of the springs can be for example from 50% to 150%, more preferably from 80% to 120% and most preferably from 90% to 100% of the maximum distance between the rear end sleeve and the forward end sleeve. Each spring can have similar or different spring constants. Use of e.g. three springs with three different spring constants enables an almost step-wise adjustment of the cleaning device which is useful under certain circumstances.

The cleaning device of the present disclosure is used by rotating the flexible shaft 15 with a motor. Rotation of the flexible shaft also rotates the sleeves 20, 30 about the flexible shaft and the chains around the flexible shaft since the chains are attached to the sleeves 20, 30 and the rear end sleeve 30 is attached to the flexible shaft 15 and the forward end sleeve is not rotatable in relation to the flexible shaft due to the shape and size of the end portion 10 of the flexible shaft and the through hole 22 of the forward end sleeve 20. Rotation of the cleaning device moves central links 25 of the chains away from the flexible shaft due to the mass of the links 25 and their angular velocity caused by the rotation of the flexible shaft. Since the chains are attached from their ends to the sleeves, the rotation of the cleaning device moves the forward end sleeve 20 towards the rear end sleeve 30 and compresses the spring 40 at the same time to allow the central links 25 of the chains to move further in the direction of force caused by the rotational movement. When the rotation speed is further increased, the force acting on the links 25 becomes stronger and moves the central links 25 further away from the flexible shaft which again forces the forward end sleeve 20 to move closer to the rear end sleeve 30 and compress the spring 40 even more. This way, by changing the rotation speed, a user can adjust diameter of the cleaning device to match the inner diameter of a pipe that is being cleaned with the cleaning device. When rotation of the flexible shaft is stopped, the chains will also stop rotating and thereby losing the force pushing them away from the flexible shaft. The forward end sleeve 20 is moved away from the rear end sleeve 30 by the force of the spring 40 acting on the sleeves 20, 30. The spring 40 extends to its full length and pulls the chains next to the flexible shaft which makes it easy to remove the cleaning device from the pipe.

Figure 3:
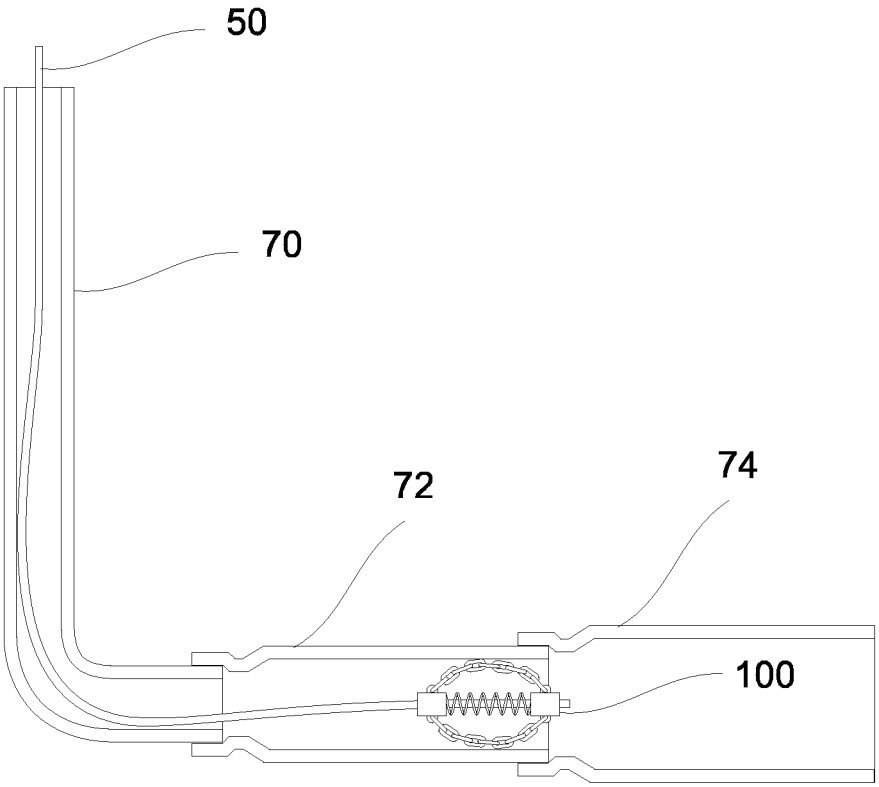
FIG. 3 illustrates use of the cleaning device of FIG. 1.

FIG. 3 illustrates a pipeline consisting of three subsequent pipes which have to be cleaned. The cleaning device is inserted into the first pipe 70 which is the smallest pipe, for example a 70 mm pipe or a 3 inch pipe. The first pipe 70 makes a 90 degree bend and connects to a second pipe 72 which can be for example a 100 mm pipe or a 4 inch pipe. After a straight segment, the second pipe connects to a third pipe 74 which can for example a 150 mm pipe or a 6 inch pipe. The cleaning device 100 is dimensioned to be capable of cleaning the third pipe 74 which is a 150 mm pipe. However, when the cleaning device 100 is not rotated, the chains run between the sleeves next to the flexible shaft so the cleaning device can be easily introduced in to the smallest pipe 70. The smallest pipe can be cleaned with low rotation speed since the chains do not have to expand far away from the flexible shaft to hit the inner wall of the pipe 70. When the smallest pipe 70 is cleaned, the same tool without modifications can be used in the second pipe 72 by increasing the rotation speed to medium speed. The higher rotation speed expands the chains further away from the flexible shaft to hit the inner wall of the pipe 72 as shown in FIG. 3. Once the second pipe 72 is cleaned, the same tool without modifications can be used in the third pipe 74 by increasing the rotation speed to high speed. The higher rotation speed expands the chains further away from the flexible shaft to hit the inner wall of the pipe 74. Once the whole pipeline has been cleaned, the rotation of the cleaning device can stopped which moves the chains next to the flexible shaft and the cleaning device can be easily pulled out through the smallest pipe 70 with the chains becoming tangled and jamming the device in the 90 degree bend, for example.

In a cleaning device 100 according to the embodiment presented in FIG. 1, two or more chains can be used between the rear end sleeve 30 and the forward end sleeve 20. Preferably, there are three chains. Specifically, in a cleaning device intended for cleaning pipes that are small in diameter, it may be advantageous to use two chains. Specifically, in a cleaning device intended for cleaning pipes that are large in diameter, it may be advantageous to use four chains. Each chain has several links 25, preferably at least five links and up to twenty links. In a cleaning device intended for exceptionally large pipes, there can be more than twenty links in each chain. For example, a cleaning device intended for pipes from 70 mm to 150 mm in diameter, can use, for example, eight to twelve links, e.g. nine or ten links. In this case, the rear end sleeve 30 is attached to the flexible shaft 15 and the forward end sleeve 20 can move freely along the end portion 10 of the flexible shaft 15 but cannot rotate about the end portion or in relation to the rear end sleeve. The spring 40 between the sleeves 20, 30 in its uncompressed state is long enough to keep the rear end sleeve so far apart from the forward end sleeve that the chains reside next to the spring 40 and the flexible shaft 15 when the cleaning device is not rotated. When the cleaning device is rotated at full speed or at speed which fully compresses the spring 40, the centremost links of the chains are about 75 mm to 90 mm distance from the flexible shaft so that the chains are able to scrape effectively the inner surface of a 150 mm pipe. In pipes of larger diameter can be used chains having more links, and in pipes of smaller diameter can be used chains having fewer links. Also smaller portions than whole links, such as, for example, half links, can be used at the ends of the chain as attached to the sleeve.

Figure 4:
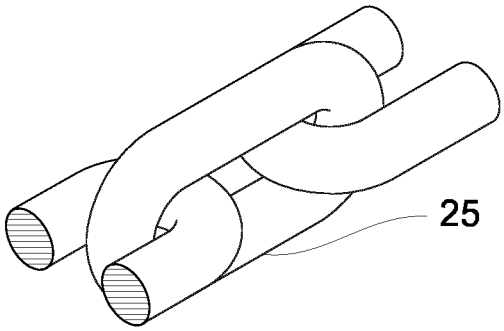
FIG. 4 illustrates a portion of a chain of a cleaning device according to an embodiment.

FIG. 4 illustrates a portion of a chain of a cleaning device according to an embodiment. It is possible to use chains without any kind of cutters attached to the chain. The lack of cutters is preferred when the cleaning device is used in pipes made out of soft materials, such as plastic, such as PVC, polyethylene or HDPE pipes. Preferably also the links closest to the sleeves are without cutters since those links do not have any cleaning function because they rarely touch a pipe wall.

Figure 5:
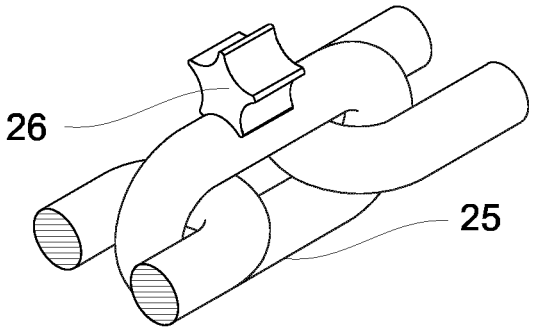
FIG. 5 illustrates a cutter on a chain link according to an embodiment.

FIG. 5 illustrates a cutter 26 on a chain link 25 according to an embodiment. The cutter 26 of this embodiment has a star shaped cross-section and has been made out of hardened steel or hard metal, such as cemented carbide. The cutter 26 can have five to ten sharp-edged ridges defining the star form. Preferably, the shape of the cutter between two of the ridges essentially matches the shape of a straight section of a link 25 of the chains. The cutters 26 are welded or soldered from between two ridges to the straight section of the link 25 on the outermost side of the cleaning device 100.

Figure 6:
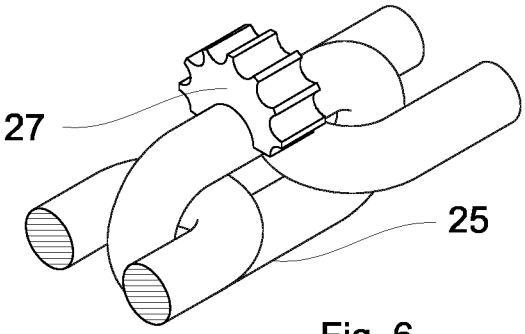
FIG. 6 illustrates a cutter on a chain link according to an embodiment.

FIG. 6 illustrates a cutter 27 on a chain link 25 according to an embodiment. The cutter 27 of this embodiment has a U-shaped cross-section with multiple sharp-edged ridges on the outer side of the cutter. The cutter 27 has been made out of hardened steel or hard metal, such as cemented carbide. The cutter 27 can have five to ten sharp-edged ridges on the outer edge of the U-shape. Preferably, the shape of the inner edge of the U-shape essentially matches the shape of a straight section of a link 25 of the chains. The cutters 27 are welded or soldered from the inner edge of the U-shape to the straight section of the link 25 on the outermost side of the cleaning device 100.

Figure 7:
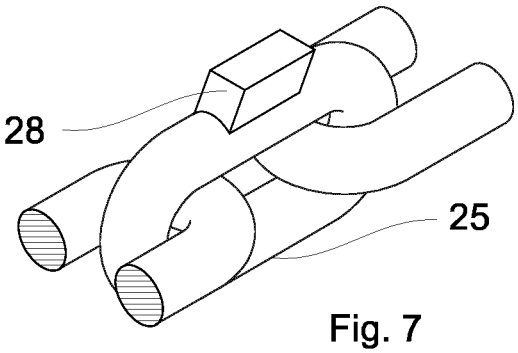
FIG. 7 illustrates a cutter on a chain link according to an embodiment.

FIG. 7 illustrates a cutter 28 on a chain link 25 according to an embodiment. The cutter 28 of this embodiment has a rectangular cross-section and a side profile of a parallelogram or a trapezoid. The cutter 28 has been made out of hardened steel or hard metal, such as cemented carbide. The cutter 28 can have parallel top and bottom surfaces, parallel side surfaces extending between the top and bottom surfaces and end surfaces which form angles of 60 to 89 degrees and 91 to 120 degrees with the top and bottom surfaces. The cutters 28 are welded or soldered from the bottom surface to the straight section of the link 25 on the outermost side of the cleaning device 100.

Figure 8:
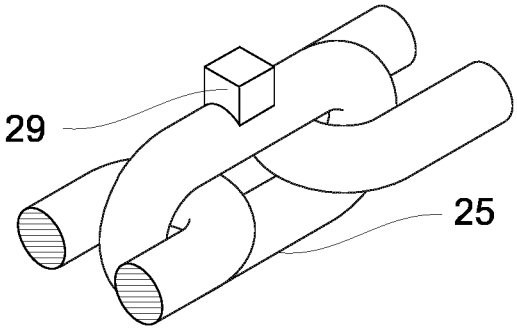
FIG. 8 illustrates a cutter on a chain link according to an embodiment.

FIG. 8 illustrates a cutter 29 on a chain link 25 according to an embodiment. The cutter 29 of this embodiment has a rectangular cross-section and a side profile of a rectangle from each side. The cutter 29 has been made out of hardened steel or hard metal, such as cemented carbide. The cutter 29 can have parallel top and bottom surfaces, parallel side surfaces extending between the top and bottom surfaces and parallel end surfaces extending between the top, bottom and side surfaces. The cutters 29 are welded or soldered from the bottom surface to the straight section of the link 25 on the outermost side of the cleaning device 100.

In an embodiment the links 25 of the chains are twisted such that the crosswise corners of each link are in the same plane with each other, but in a different plane than the adjacent corners. The planar difference of the adjacent corners is the thickness of a strand of the chain or greater in size, wherein the successive links as placed into the plane are to be placed in the same position. In this case, the cutters 26, 27, 28 or 29 are attached to those crosswise corners of the chain, which are outermost from the plane, wherein the cutters protrude from the chain and from the plane as much as possible and the cutter pairs are in each link on the same side and parallel with each other, when the chain is placed into a plane, for example, against a planar surface. The cutters can be cutters according to embodiments shown in FIGS. 5 to 8.

An embodiment of the present disclosure is a cleaning device for cleaning the inner surface of a pipe, the device comprising a flexible shaft running through a rear end sleeve 30 attached to the flexible shaft and a forward end sleeve 20, the cleaning device further comprising chains composed of links 20, each chain extending between the rear end sleeve 30 and the forward end sleeve 20 and being attached to said rear end sleeve 30 and to said forward end sleeve 20. The cleaning device further comprises a spring 40 around the flexible shaft 15 located between said rear end sleeve 30 and said forward end sleeve 20, and the forward end sleeve 20 defines a through-hole 22 having a non-circular cross-section, and the flexible shaft 15 has an end portion 10 having a non-circular cross-section running through the through-hole 22 of the forward end sleeve 20, wherein the forward end sleeve 20 is movable along the end portion 10 of the flexible shaft.

In an embodiment of the present disclosure, the through-hole 22 of the forward end sleeve 20 is sized or shaped or both sized and shaped to allow movement of the forward end sleeve 20 along the end portion 10 of the flexible shaft 15 and to prevent rotation of the forward end sleeve 20 on the end portion 10 of the flexible shaft 15.

In an embodiment of the present disclosure, the rear end sleeve 30 is arranged to be attached to the flexible shaft 15 by means of one or more friction screws 32.

In an embodiment of the present disclosure, the cleaning device comprises two or three chains composed of links 25, which chains are attached by welding to the sleeves by attaching a link 25 at the end of each chain to the rear end sleeve 30 and another link 25 at the opposite end of the chain to the forward end sleeve 20.

In an embodiment of the present disclosure, one or more of the links 25 of the chains comprise a cutter 26, 27, 28, 29 attached to the link by means of welding or soldering. The cutter is preferably a cemented carbide cutter.

It is obvious to the skilled person in the art that, as technology develops, the basic idea of the invention can be implemented in various ways. The invention and its embodiments are thus not limited to only the examples presented above, rather many variations are possible within the scope of the claims.

While the present invention has been described in accordance with preferred compositions and embodiments, it is to be understood that certain substitutions and alterations may be made thereto without departing from the spirit and scope of the following claims.

I claim:

1. A cleaning device for cleaning the inner surface of a pipe, the cleaning device comprising:

a flexible shaft extending through a rear end sleeve attached to the flexible shaft and a forward end sleeve, chains composed of links, each chain extending between the rear end sleeve and the forward end sleeve and being attached to said rear end sleeve and to said forward end sleeve, a spring around the flexible shaft located between said rear end sleeve and said forward end sleeve, the forward end sleeve having a through-hole defined therein having a non-circular radial cross-section, the flexible shaft having an end portion having a non-circular radial cross-section extending through the through-hole of the forward end sleeve, and the forward end sleeve being movable along and rotatably driven by the end portion of the flexible shaft.

2. The cleaning device according to claim 1, wherein the through-hole of the forward end sleeve is sized to allow movement of the forward end sleeve along the end portion of the flexible shaft and to prevent rotation of the forward end sleeve on the end portion of the flexible shaft.

3. The cleaning device according to claim 1, wherein the rear end sleeve is arranged to be attached to the flexible shaft by friction screws.

4. The cleaning device according to claim 1, wherein the cleaning device has two or three chains composed of links, which chains are attached by welding to the sleeves by attaching a link at the end of each chain to the rear end sleeve and another link at the opposite end of the chain to the forward end sleeve.

5. The cleaning device according to claim 1, wherein one or more of the links of the chains comprise a cutter attached to the link by welding or soldering.

6. The cleaning device according to claim 5, wherein the cutter is a cemented carbide cutter attached to the link by soldering.

* * * * *